US005104008A

United States Patent [19]

Crisci

[11] Patent Number: 5,104,008

[45] Date of Patent: Apr. 14, 1992

[54] RESEALABLE BOTTLE CAP WITH PUSH-PULL CLOSURE

[75] Inventor: Robert E. Crisci, New Castle, Pa.

[73] Assignee: Northern Engineering and Plastics Corp., New Castle, Pa.

[21] Appl. No.: 621,006

[22] Filed: Dec. 3, 1990

[51] Int. Cl.[5] ..... B67D 5/32

[52] U.S. Cl. ..... 222/153; 222/525; 222/541; 215/253; 215/356

[58] Field of Search ..... 222/153, 521, 524, 525, 222/541; 215/253, 256, 258

[56] References Cited

U.S. PATENT DOCUMENTS

| | | | |
|---|---|---|---|
| 2,998,902 | 9/1961 | Thomas et al. | 222/525 |
| 3,902,621 | 9/1975 | Hidding | 215/252 |
| 4,330,067 | 5/1982 | Deussen | 215/258 |
| 4,469,253 | 9/1984 | Beard | 222/153 |
| 4,500,016 | 2/1985 | Funtstuck | 222/153 |
| 4,561,553 | 12/1985 | Crisci | 215/256 |
| 4,589,561 | 5/1986 | Crisci | 215/256 |
| 4,779,764 | 10/1988 | Debetencourt | 222/153 |
| 4,801,032 | 1/1989 | Crisci | 215/256 |
| 4,805,807 | 2/1989 | Perne et al. | 222/153 |
| 4,948,003 | 8/1990 | Munoz | 215/253 |

FOREIGN PATENT DOCUMENTS

| | | | |
|---|---|---|---|
| 2216505 | 10/1989 | United Kingdom | 215/256 |

*Primary Examiner*—Michael S. Huppert
*Assistant Examiner*—Kenneth Bomberg
*Attorney, Agent, or Firm*—Harpman & Harpman

[57] ABSTRACT

A cap for a bottle, such as a blow molded sports's water bottle, having a neck surrounding an opening therein and a pair of vertically spaced fastening configurations on the exterior thereof, the cap having an annular tear skirt depending therefrom, the tear skirt having a pull tab for the removal thereof, the cap having an upstanding pour spout or tube registering with an opening in the center of the cap and a smaller diameter plug positioned thereabove on a plurality of upwardly angled legs on said pour spout. A pair of annular ribs are formed on the exterior of the pour spout to permit vertical movement of a top cap having an opening therein registrable with said plug. An annular ring having an inturned annular flange thereon is positioned on the pour spout below one of said annular ribs and is detachably secured to the top cap by a plurality of frangible elements. The bottle cap forms a first closure on the water bottle and the top cap forms a second closure, the bottle cap being replaceable on the water bottle when the annular tear skirt is removed.

5 Claims, 2 Drawing Sheets

RESEALABLE BOTTLE CAP WITH PUSH-PULL CLOSURE

BACKGROUND OF THE INVENTION

1. Technical Field:

This invention relates to tamper indicating closures for containers, such as blow molded plastic bottles, such as used by sport's figures as water bottles and/or beverage containers.

2. Description of the Prior Art:

Prior closures of this type may be seen in U.S. Pat. Nos. 3,902,621, 4,469,253, 4,500,016, 4,561,553, 4,589,561, 4,801,032, and 4,948,003.

The present invention provides a novel resealable bottle cap with dual resealable elements and in part resembles the tamper-evident closure of U.S. Pat. No. 4,589,561 above-referred to.

SUMMARY OF THE INVENTION

A tamper-evident resealable bottle cap for bottles, such as blow molded water bottles with appropriate neck configurations, takes the form of a cap portion having a top and an annular depending flange on its peripheral edge radially spaced with respect to an annular sealing flange. An opening in the top of the cap communicates with an upstanding cylindrical pour spout, the upper end of which is partially closed by a secondary top having a secondary opening therein and a plug spaced thereabove by upwardly angled legs formed integrally with the secondary top.

A pair of vertically spaced annular ribs are formed on the exterior of the pour spout, one of which is adjacent the upper end thereof and the other of which is spaced therebelow. A separate top cap comprising a cylindrical body member has a ring spaced closely to its lower peripheral edge by a plurality of integrally formed frangible elements. The ring has an inturned annular flange movably engaging the upstanding pour spout below the lower one of said annular ribs and the top cap has a pair of inturned annular flanges spaced midway between its upper and lower ends engaging the upstanding pour spout below the uppermost annular rib on the exterior thereof. A top portion on the top cap has a central opening in which said plug registers to form a closure. The top cap cannot be moved upwardly to free the opening therein from the plug until it is moved sufficiently vertically to separate the annular ring therefrom by breaking the frangible elements joining the same thereto. The ring and the top cap are so positioned on the upstanding pour spout as to be non-removable therefrom and thus rendering the resealable bottle cap child-safe.

The depending annular flange on the lower portion of the resealable bottle cap has an annular area of weakness defining a tear skirt and a pull tab is secured thereto so that the tear skirt can be removed. The resealable bottle cap has an inturned annular flange above the annular area of weakness which forms a snap-on fastening configuration enabling the resealable bottle cap to be repositioned on a water bottle or the like so as to form a first replaceable closure while the top cap forms a second push-pull resealable closure.

DESCRIPTION OF THE PREFERRED EMBODIMENT

Figure 5:
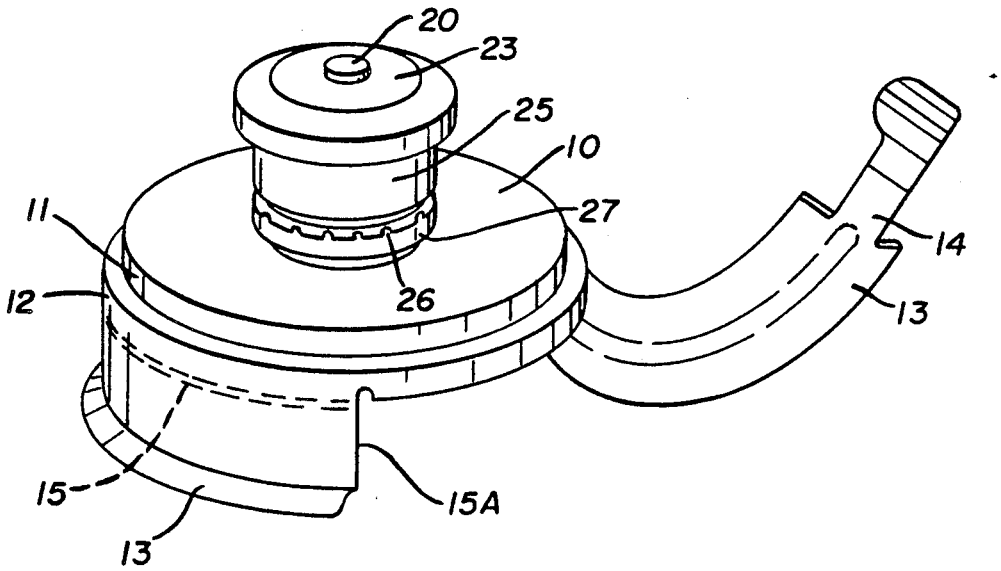
FIG. 5 is a perspective view of the resealable bottle cap with a portion of the tear skirt removed.
Figure 6:
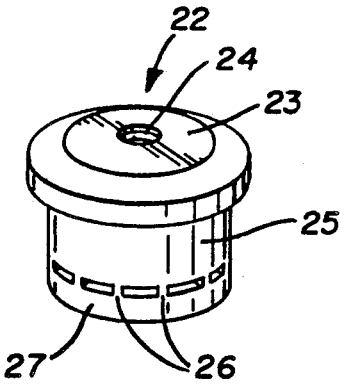
FIG. 6 is a perspective view of the top cap portion of the resealable bottle cap prior to assembly on the remainder of the cap.

By referring to FIG. 5 of the drawings, a broken line representation of the upper portion of a water bottle may be seen with a perspective view of the resealable bottle cap with a push-pull closure positioned thereon and comprising a top portion 10 with a depending annular flange of different diameters, one of which forms a relatively short first portion 11 and the other forms a larger diameter portion 12 of the depending annular flange.

An outturned angular flange 13 is formed on a majority of the lower edge of the depending annular flange 12 and a pull tab 14 is attached to the depending annular flange 12 in the area between the ends of the outturned angular flange 13.

Still referring to FIG. 5 of the drawings, the larger diameter depending annular flange 12 is provided with an annular area of weakness comprising a tear groove 15 which enables the lower portion of the second annular flange 12 to be removed when the tear tab 14 is held and moved outwardly and around the resealable bottle cap.

Figure 1:
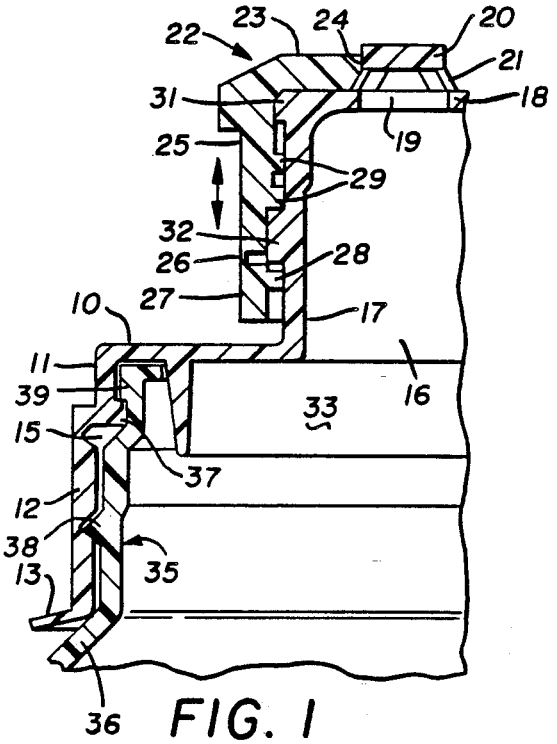
FIG. 1 is a vertical section through a portion of the resealable bottle cap with the push-pull top portion thereof in closed and sealed position.

By referring now to FIG. 1 of the drawings, it will be seen that an opening 16 is formed in the center of the top 10 of the cap and that an upstanding cylindrical pour spout 17 is positioned in registry with the opening 16, the upper end of the pour spout 17 having a secondary top portion 18 thereon which is apertured at 19. A plug 20 is positioned on the secondary top 18 in spaced relation to the aperture 19 by a plurality of circumferentially spaced angularly arranged legs 21.

Still referring to FIG. 1 of the drawings it will be seen that a push-pull top cap 22 is positioned on the upstanding cylindrical pour spout 17 and comprises a top portion 23 having a central opening 24 therein which registers with the plug 20 to form a closure when the top portion 23 is in the position illustrated in FIG. 1 and resting on the secondary top 18 of the upstanding cylindrical pour spout 17. The top cap 22 has a depending cylindrical body member 25 and is connected by a plurality of frangible elements 26 on its lower edge with a ring 27. The ring 27 has an inturned annular flange 28 thereon which slidably engages the exterior of the upstanding cylindrical pour spout 17 and the depending cylindrical body member 25 of the top cap 22 has a pair of inturned annular flanges 29 which slidably engage the outer surface of the upstanding cylindrical pour spout 17. There are two outturned annular flanges 31 and 32 respectively, formed on the exterior of the upstanding cylindrical pour spout 17, the outturned flange 31 being oppositely disposed with respect to the secondary top 18 and the outturned flange 32 being spaced therebelow and above the top 10 of the bottle cap so that vertical movement of the push-pull top cap 22 is limited.

Figure 2:
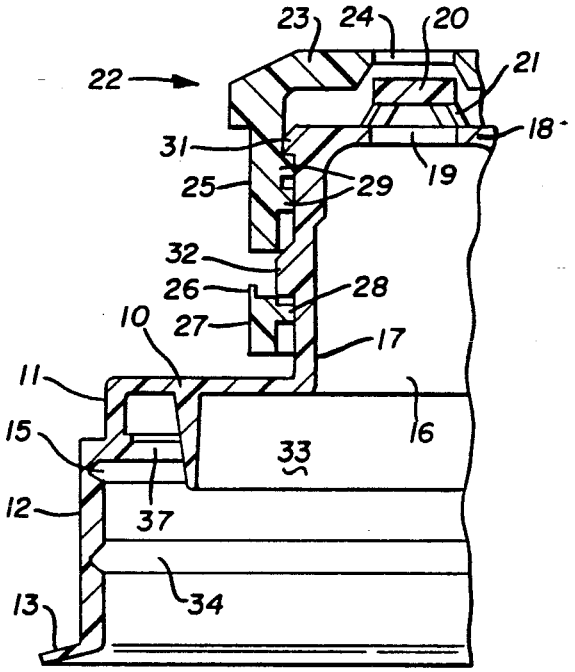
FIG. 2 is a vertical section through a portion of the resealable bottle cap on a neck finish with the push-pull top portion shown in open position.
Figure 4:
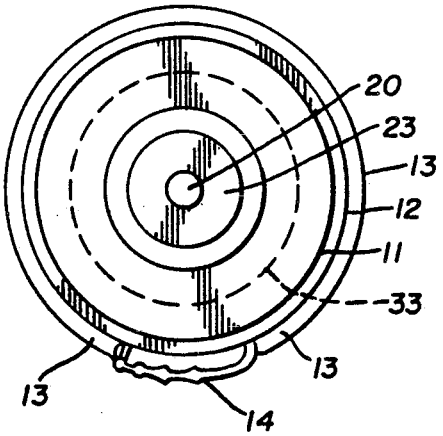
FIG. 4 is a top plan view of the resealable bottle cap.

In the assembled form illustrated in FIG. 1 of the drawings, the integral ring 27 joined by the frangible elements 26 to the cylindrical body member 25 of the top cap 22 is incapable of moving upwardly due to the inter-engagement of the inturned flange 28 thereon with the outturned flange 32 on the cylindrical pouring spout 17 and the cylindrical body member 25 of the top cap 22 is incapable of vertical movement such as necessary to move the apertured top 23 thereof above the plug 20 until sufficient force is applied to the top cap 22 to break away the frangible elements 26 whereby the top cap 22 can move to the position illustrated in FIG. 2 wherein the opening 24 therein moves upwardly and away from the plug 20. The inturned annular flanges 29 on the cylindrical body member 25 of the top cap 22 cannot move above the outturned annular flange 31 on the secondary top 18 of the upstanding cylindrical pour spout 17 so that the push-pull top cap of the bottle cap is child-safe as it is not removable therefrom.

Figure 3:
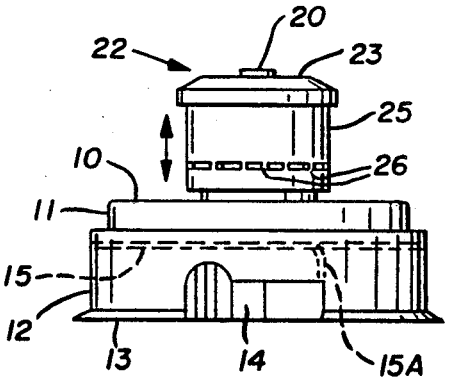
FIG. 3 is a side elevation of the resealable bottle cap.

In FIG. 3 of the drawings, a side elevation of the resealable bottle cap with push-pull closure may be seen in its initial assembled condition as hereinbefore described in connection with FIGS. 1 and 5 of the drawings, and it will be seen that there is a vertical area of weakness 15A extending between the lower edge of the larger depending flange 12 and the tear groove 15.

Those skilled in the art will observe that the larger diameter depending annular flange 12 of the bottle cap which engages the neck finish 35 of a water bottle 36 or the like is provided with two configurations for engaging, matching, or registering with configurations on the neck finish. These comprise an inturned annular flange 37 on the lower inner edge of the first depending annular flange 11 of the bottle cap which is in opposed relation to the conventional depending sealing flange 33 of such caps and an annular groove 34 in the larger diameter depending annular flange 12. The blow molded water bottle 36 or similar containers having appropriately shaped neck finish 35 including annular ribs 38 and 39 on their outer surfaces will accordingly register with the configuration, 37 extending inwardly from said first portion and said groove 34 in said depending annular flange 12 illustrated in the present disclosure.

It will thus be seen that the resealable bottle cap with a push-pull closure of the present invention forms an attractive and very practical closure for a water bottle such as used in various sports such as bicycle races and the like, in that the bottles which are initially filled and sealed by the application of the resealable bottle cap will retain the bottle cap in position due to the registering configurations in the depending annular flanges of the portion of the cap engaging the water bottle finish and at the same time provide a tamper-indicating sealed closure with respect to the upstanding cylindrical pour spout of the invention which must be forcibly opened by moving the push-pull top cap 22 upwardly so as to break the frangible elements 26 to open the aperture 19 therein and permit the contents of the water bottle to be used. At such time as the water bottle 36 is empty, it may be refilled by using the tear tab 14 to remove the major portion of the larger diameter depending flange 12 from the bottle cap which can then be removed by forcibly disengaging the inturned annular flange 37 from a matching configuration on the water bottle neck finish. This latter feature permits the bottle cap to be repositioned on the refilled water bottle where it holds tightly and permits the push-pull top cap 22 to be opened and closed in the same manner as was provided by the original complete resealable bottle cap assembly.

Those skilled in the art will observe that the device of the invention is advantageously formed of resilient molded plastic material such as polyethylene.

Having thus described my invention, what I claim is:

1. An improvement in a resilient molded plastic resealable bottle cap for a water bottle having a neck surrounding an opening to the water bottle and having dual bottle cap retaining means on the exterior of said neck, said bottle cap having a top for covering said opening to said water bottle and a depending annular flange surrounding said neck, said depending flange having means for engaging said dual bottle cap retaining means and an annular groove forming an area of weakness positioned in the inner surface of said depending annular flange, the depending flange below said annular groove defining a tear skirt, said tear skirt having a pull tab affixed thereto; the improvement comprising an upstanding pour spout on said top of said bottle cap communicating with an opening in said top, said pour spout having an apertured secondary top thereon and means on said secondary top positioning a plug in spaced relation to said secondary top and said aperture, a top cap movably disposed on said pouring spout and having an opening registering with said plug to form a closure when said top cap is in a first position, a ring and a plurality of frangible elements integrally connecting said ring with said top cap in said first position and on a flange on said pour spout retaining said ring in said first position when said top cap is moved away from said first position to a second position locating said opening in said top cap in spaced relation to said plug.

2. The improvement in a resilient molded plastic resealable bottle cap of claim 1 wherein said dual retaining means comprising annular flanges on said neck and means on said depending flange for engaging said dual retaining means comprising an annular flange and an annular groove on the inner surface of said depending flange of said bottle cap.

3. The improvement in a resilient molded plastic resealable bottle cap of claim 1 wherein said means on said pour spout and said ring retaining said ring in said first position comprise an annular flange on said pour spout and an inturned annular flange on said ring.

4. The improvement in a resilient molded plastic resealable bottle cap of claim 1 wherein said upstanding pour spout has a tubular body of a known outer diameter and said top cap has a cylindrical body, the inner diameter of which is greater than said known outer diameter of said tubular body.

5. The improvement in a resilient molded plastic resealable bottle cap of claim 1 wherein said means on secondary top spacing said plug with respect to said secondary top and said aperture therein consist of upstanding legs integrally formed with said secondary top and said plug said legs registerable with said top portion when in said first position.

* * * * *

UNITED STATES PATENT AND TRADEMARK OFFICE

CERTIFICATE OF CORRECTION

PATENT NO. : 5,104,008

DATED : April 14, 1992

INVENTOR(S) : Robert E. Crisci

It is certified that error appears in the above-indentified patent and that said Letters Patent is hereby corrected as shown below:

In line 23 of claim 1 [col. 4, line 35] delete "on".

Signed and Sealed this

Twenty-seventh Day of October, 1998

*Attest:*

Bruce Lehman

BRUCE LEHMAN

*Attesting Officer*

*Commissioner of Patents and Trademarks*